US009320374B2

(12) United States Patent
Phipps

(10) Patent No.: US 9,320,374 B2
(45) Date of Patent: Apr. 26, 2016

(54) MAIN BODY

(71) Applicant: Jeff Phipps, Tallahassee, FL (US)

(72) Inventor: Jeff Phipps, Tallahassee, FL (US)

( * ) Notice: Subject to any disclaimer, the term of this patent is extended or adjusted under 35 U.S.C. 154(b) by 0 days.

(21) Appl. No.: 14/494,548

(22) Filed: Sep. 23, 2014

(65) Prior Publication Data

US 2015/0083732 A1 Mar. 26, 2015

Related U.S. Application Data

(60) Provisional application No. 61/881,001, filed on Sep. 23, 2013.

(51) Int. Cl.

| | |
|---|---|
| ***A47G 19/22*** | (2006.01) |
| ***B65D 81/32*** | (2006.01) |
| ***A47G 19/02*** | (2006.01) |
| ***A45F 3/16*** | (2006.01) |

(52) U.S. Cl.

CPC ..... *A47G 19/2211* (2013.01); *A45F 3/16* (2013.01); *A47G 19/02* (2013.01); *B65D 81/3216* (2013.01); *B65D 81/3222* (2013.01)

(58) Field of Classification Search

CPC ..... A47G 19/2211; A47G 19/02; B65D 81/3216; B65D 81/3222

USPC ..... 220/501, 704, 703, 719, 731, 716, 220/574.2; 426/115

See application file for complete search history.

(56) References Cited

U.S. PATENT DOCUMENTS

| | | | | | |
|---|---|---|---|---|---|
| 2,748,946 | A * | 6/1956 | Smith | 210/244 |
| 3,150,084 | A * | 9/1964 | Rodges | 210/469 |
| 3,272,395 | A * | 9/1966 | Lawyer | 222/189.07 |
| 3,917,533 | A * | 11/1975 | Macaluso, Jr. | 210/469 |
| 5,676,275 | A | 10/1997 | Khattar | |
| 5,727,712 | A | 3/1998 | Costello | |
| 5,853,106 | A | 12/1998 | Galluzzo | |
| 6,047,845 | A | 4/2000 | Rapaz | |
| 8,574,647 | B1 * | 11/2013 | Gunderson | 426/115 |
| 2005/0072787 | A1 * | 4/2005 | Morris et al. | 220/712 |

* cited by examiner

*Primary Examiner* — Jeffrey Allen
*Assistant Examiner* — Jennifer Castriotta
(74) *Attorney, Agent, or Firm* — J. Wiley Horton

(57) ABSTRACT

A device for retaining solid portions of a food product that contains solid and liquid components. The device comprises an opening, angled side walls, and an angled bottom surface that acts as a bottom surface. The device fits into a liquid container, such as a soup cup. The angled sidewalk cause a wedging effect that keeps the invention from dropping down to the bottom of the liquid container. The bottom surface contains a perforated region that allows the liquid element of the food product to flow through to the bottom of the liquid container, but retaining the solid portions. By retaining the solid portions of the food product proximate the mouth of the liquid container, the user is able to consume the solid portions of the food product without a utensil. In addition, the design of the invention forces the solid elements into the user's mouth.

18 Claims, 11 Drawing Sheets

MAIN BODY

CROSS-REFERENCES TO RELATED APPLICATIONS

This is a non-provisional patent application which claims the benefit of an earlier-filed provisional application pursuant to 37 CFR. §1.53(c). The earlier application was filed on Sep. 23, 2013, and was assigned U.S. Ser. No. 61/881,001. It listed the same inventor.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of food and beverage containers. More specifically, the device comprises a device for separating liquid and solid portions of soup within a container.

2. Description of Related Art

While the customary method for consuming soup is using a soup bowl and spoon, oftentimes a user will consume soup using a soup cup or another cup designed to hold contents that are hot such as a coffee mug or similar beverage container. Typically, an individual uses a beverage container instead of a bowl or larger container if he or she is on the go or does not have the time to sit and eat with a bowl and spoon, if the person is driving a car, or he or she may simply prefer eating soup from a more portable container. On most of these occasions the user is limited to using only one hand, in other words, the user is not able to hold the soup container in one hand while holding a spoon or other implement in the other hand.

An issue that arises when drinking soup from a cup is that the solid portions of the soup fall to the bottom of the cup. This makes it difficult for the consumer to ingest the solid portions without using a utensil or waiting until all the liquid contents of the soup are consumed. A simple solution to this dilemma is separating the solid portions of the soup from the liquid component.

The issue of separating solids from liquids in terms of food product consumption has long been recognized. An example of this is found in U.S. Pat. No. 4,020,532 to Lichter (1977). The Lichter invention comprises a horizontally oriented, perforated surface that partially spans the inner cross section of a beverage container and clips to the lip of the container. The purpose of the device is to prevent ice from reaching the consumer's mouth or face, while allowing liquid to flow through the perforated holes contained in the device.

A few inventors took Lichter's invention and improved upon it. U.S. Pat. No. 5,727,712 (1998) to Costello describes a similar horizontal, perforated surface that clips to the lip of a beverage container. Costello improved upon the approach from Lichter by making the height of the bottom surface adjustable and by introducing a beverage container designed for the perforated surface.

U.S. Pat. No. 5,853,106 (1998) to Galluzzo describes yet another ice retaining device 10 that contains a perforated semi-circle 12 with a wedge 14 missing from the center. FIG. 1 shows the prior art presented by Galluzzo. The wedge 14 allows space for a user's nose and adjustability to fit the beverage container 16. In addition, the device is slanted downward, away from the lip of the container, to avoid interfering with the consumer's drinking experience. These devices are designed to keep solids away from the user's mouth and face.

U.S. Pat. No. 5,676,275 (1997) to Khattar and U.S. Pat. No. 6,135,307 (2000) to Fahy both relate to cereal bowls. The Khattar device provides a cereal bowl with two compartments that allow the consumer to saturate the cereal one spoonful at a time. The Fahy device provides a method for sieving out unwanted crumbs and broken up pieces of cereal.

U.S. Publication No. 2010/0001007 to Ferraro comprises a self-contained bowl used for separating solids from liquids. The Ferraro invention has an upper bowl containing a perforated area and a lower bowl. The upper bowl retains any solids while the lower bowl collects the liquid component of the food product. Although the prior art device is designed to separate solids from liquids and to keep the solids near the mouth of the container, the device is not intended for the food product to be consumed from the device. Analysis of the design demonstrates that the design is intended to separate the solids from the liquids, then transfer the contents as the consumer sees fit.

The prior art has attempted to solve the issue of separating solid portions of a food product from the liquid portions. While the prior art discloses methods for separating the solid portions of soup from the liquid portions, the most relevant techniques require using a device that simply separates the components without a means to efficiently consume the solid portion. The current invention solves this problem. The current invention allows the consumer to easily consume the solid portions of the soup by keeping the solid portions proximate the mouth of the cup. The device also allows for one-handed operation.

BRIEF SUMMARY OF THE PRESENT INVENTION

The present invention comprises a flexible insert with a circular cross-section for separating the solid and liquid components of soup or other food product. Preferably, the inventive device fits into a liquid container, such as a soup cup or coffee mug. After inserting the soup separating device, soup is poured into the cup. Once soup is poured into the cup, the solid portions are preferably retained near the mouth of the cup by the slanted surface that acts as a bottom surface to the solid contents while the liquid portion of the soup flows freely through openings in the device. The bottom surface is preferably angled positively from the horizontal plane (preferably, between 10 and 80 degrees).

In addition to separating the solid and liquid contents of the soup, the current invention is designed to deposit the solid elements of the soup into the mouth of the user as the user tips the soup cup to drink. This action results from the liquid flowing through the perforated region of the bottom surface and pushing the solid parts towards the mouth of the container.

The device is capable of being inserted into any cup. The preferred embodiment comprises sidewalls that are slanted in a manner such that the cross-sectional area of the device decreases as it approaches the bottom surface (and bottom of the cup). This will create a wedging effect as the invention is placed into a cup. In addition, angled side walls allow the inventive device to fit in different sized containers. In a more preferred embodiment, the material of the device is microwavable. All embodiments provide a method to keep the solid portions retained while maintaining simplicity and portability, which is not offered in the prior art.

The present invention solves the problem of not having a portable, "one-size-fits-all" main body that is especially designed to drive the solid portions of the consumer's soup into the mouth of the consumer by means of an angled, perforated retention device.

REFERENCE NUMERALS IN THE DRAWINGS

| | |
|---|---|
| 10 ice retaining device | 12 perforated semi-circle |
| 14 wedge | 16 beverage container |
| 18 ice | 20 main body |
| 21 opening | 22 perforated region |
| 24 bottom surface | 26 soup cup |
| 28 outer side wall | 30 lip |
| 32 perforation holes | 34 liquid soup level |
| 36 solid portions | 38 liquid soup level of bottom surface |
| 40 slot | 42 fluid slot |
| 44 fluid channel | 46 container cover |
| 48 sealing diameter | 50 cover opening |
| 52 container opening cover | |

DETAILED DESCRIPTION OF THE INVENTION

The present invention comprises a removable insert which includes an angled bottom surface used to separate the solid and liquid portions of soup to be consumed from a beverage container. Preferably, the beverage container is designed for contents which have a high temperature, such as a coffee cup or a soup cup. There are many advantages to consuming soup from a soup cup versus a spoon and bowl combination. One benefit includes the ability to consume the soup using a single hand. This allows the user more freedom to perform other tasks that would not be possible or convenient if the soup were to be consumed from a bowl using a spoon. For example, the user may consume the soup while operating a vehicle or using an electronic device (such as, a computer or cellular phone).

Figure 1:
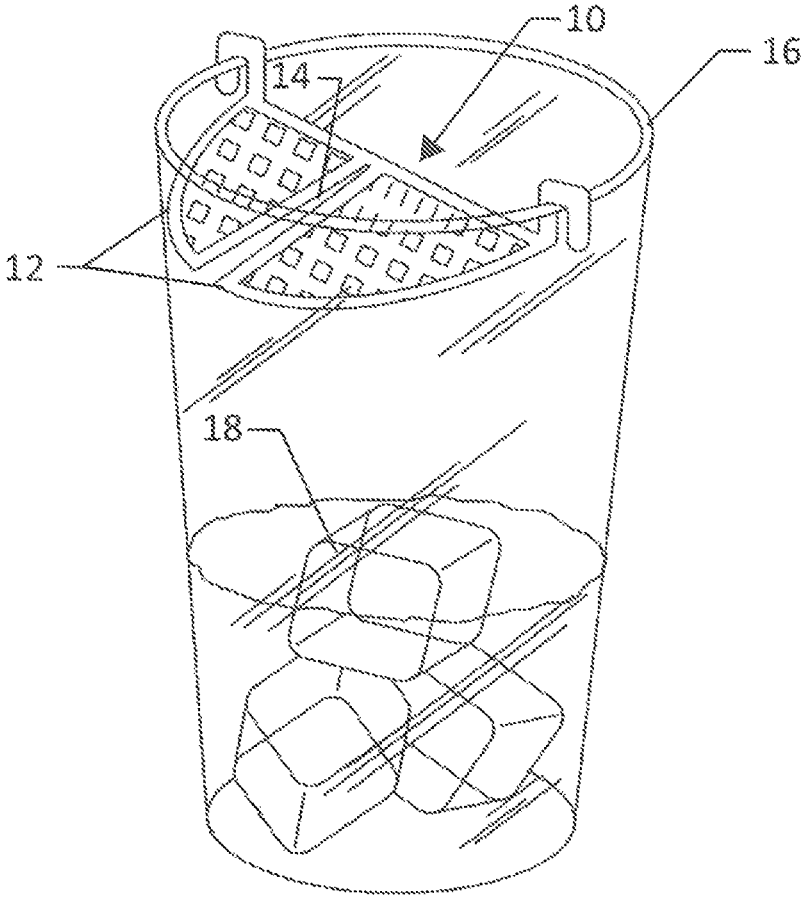
FIG. 1 (PRIOR ART)
FIG. 1 is a perspective view, showing a prior art ice retention device.
Figure 2:
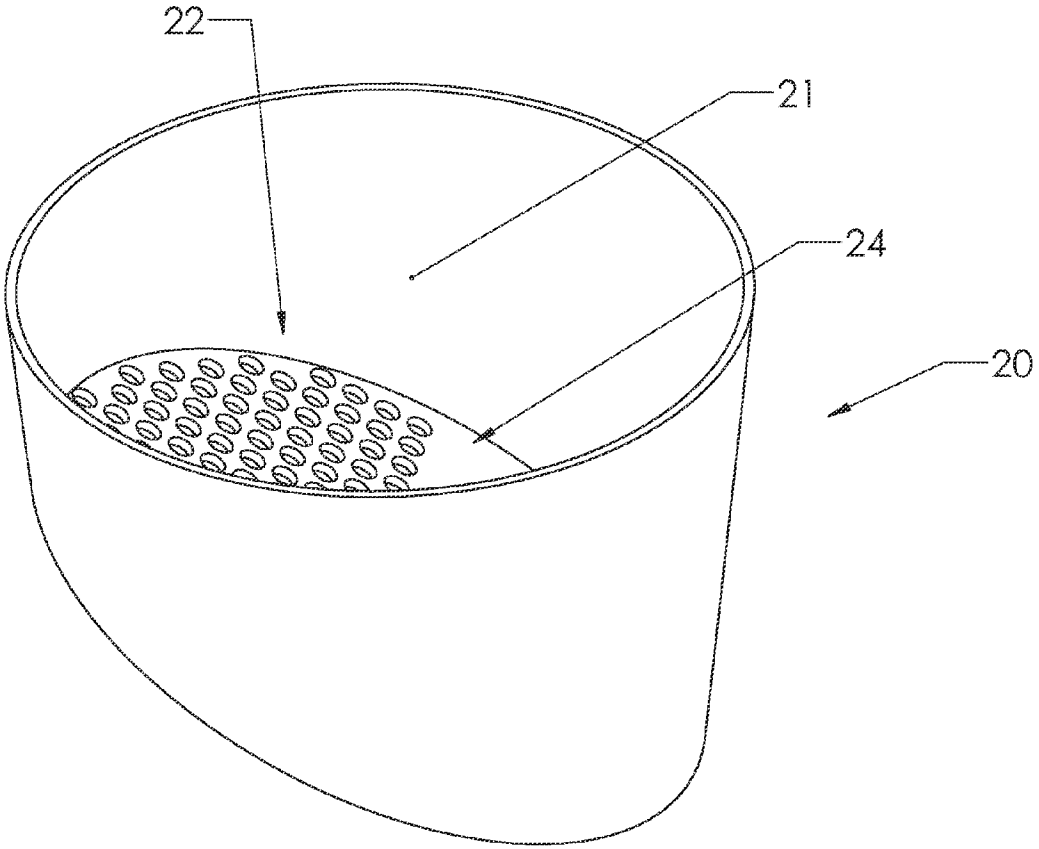
FIG. 2 is a perspective view, showing a preferred embodiment of the present invention.

FIG. 2 shows a perspective view of main body 20. Main body 20 includes opening 21, whereby the contents to be consumed can be poured. This view illustrates the area of perforated region 22 on bottom surface 24. Bottom surface 24 acts as a separator, allowing liquid to flow through to the bottom of a container while retaining the solid portions of the soup as the soup is poured into the container. While the embodiment in FIG. 2 shows perforated region 22 encompassing approximately 50 percent of bottom surface 24, this is not intended to limit the percentage of bottom surface 24 containing perforated region 22. The intent is to demonstrate that bottom surface 24 does not require perforated region 22 to completely encompass the surface of bottom surface 24. Nor should the passages through the bottom surface be viewed as being limited to a series of small perforations as illustrated. The passages may be larger and of many different shapes. For example, some embodiments may only include a single passage or a series of slots.

Figure 3:
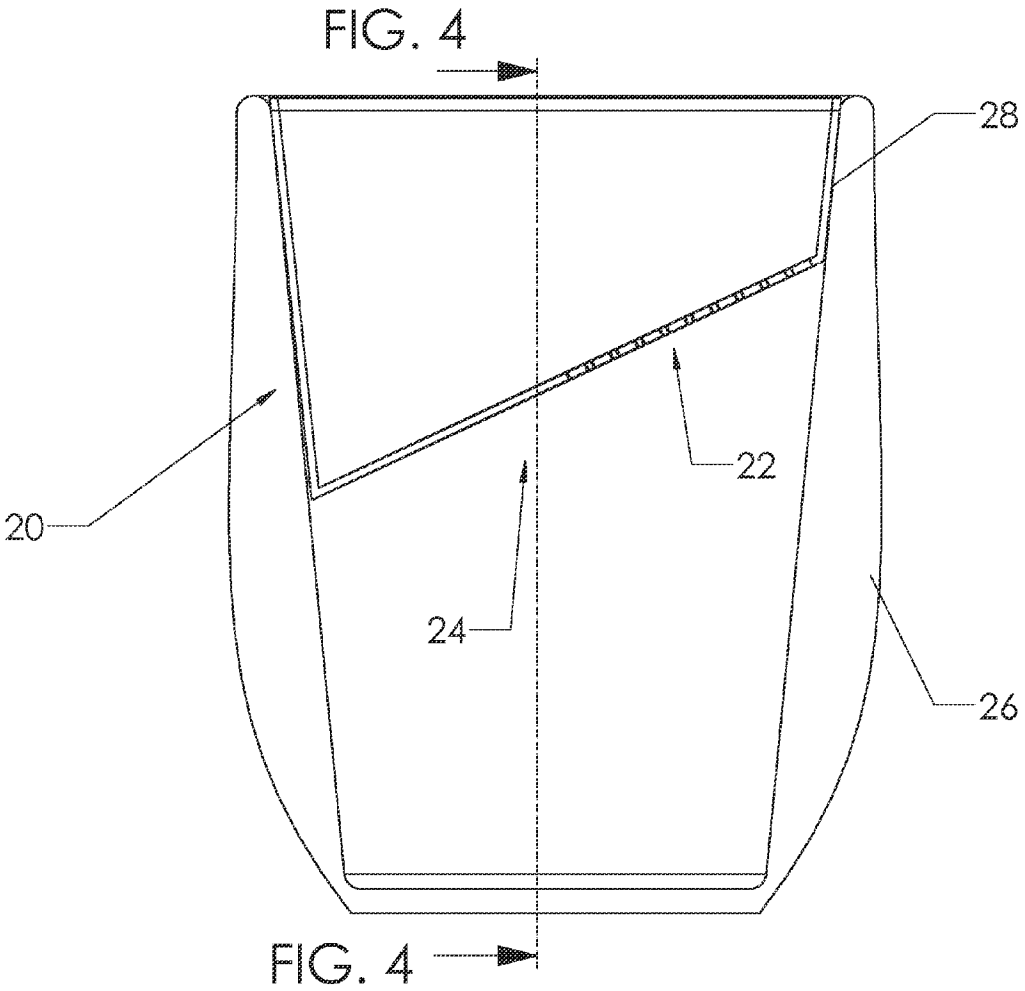
FIG. 3 is an elevation view, showing the present invention set inside a liquid container, such as a soup cup.
Figure 4:
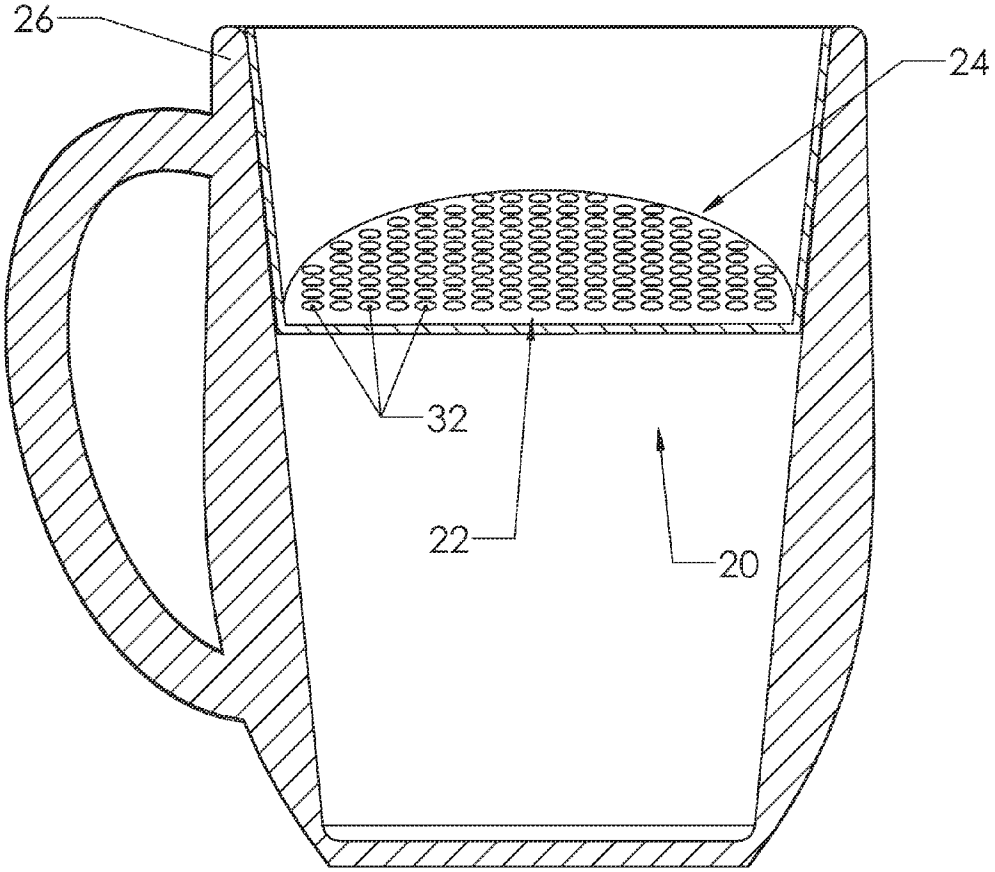
FIG. 4 is a sectional view, showing the current invention set inside a soup cup.

FIG. 3 shows a liquid container intended for contents that are hot, such as a soup cup, with the current invention placed within it. The reader will note that hidden lines are visible in the figure in order to easily illustrate the present invention inserted into a beverage container. In addition, a cut line for FIG. 4 is shown. Soup cup 26 comprises a circular cross-section with a handle that allows a user to hold the container while the contents are hot without burning one's hand. While it is designated as a "soup cup" in the view, the shape is the same as a prior art mug used for coffee or tea and should be taken as any beverage or heated contents holder known in the art. Main body 20 also has a circular cross-section. It fits into soup cup 26 as shown in FIG. 3. Main body 20 preferably has angled outer side walls 28. Outer side walls 28 are preferably angled in such a way that the cross-sectional area of main body 20 decreases when traveling in a downward direction with respect to the view in FIG. 3. (The largest cross-section of the invention is at the mouth of the soup cup and the smallest cross-section is closest to the bottom of the soup cup.) Angled side walls 28 allow the weight of the solid portions of soup to force the current invention down into soup cup 26 (which has angled inner side walls), thereby wedging main body 20 into soup cup 26. The cross-sectional area of main body 20 is large enough near the mouth of soup cup 26 as to not let the main body drop to the bottom of the soup cup. Thus, the bottom edge of the sidewall does not contact the base of the prior art container. Applicant refers to the bottom surface as "free" of the base of the prior art container. The reader will appreciate that the term "free" as used herein simply means that the bottom surface of the main body 20 does not contact the base of the container in the present embodiment. However, the main body 20 remains securely positioned within the prior art container.

FIG. 4 shows the sectional view indicated in FIG. 3, which is located just off-center of the assembly. As the view in FIG. 3 shows, bottom surface 24 is angled downward from right to left. FIG. 4 shows the full extent of perforated region 22 on the upper half of angled bottom surface. In this view, the reader can see that perforated region 22 spans a full semi-circle (50 percent of bottom surface 24). In addition, FIG. 4 allows the reader to see the fit of main body 20 in soup cup 26. Because soup cup 26 and main body 20 have angled mating surfaces, main body 20 wedges into soup cup 26. This wedging effect is also caused by the force of the soup on bottom surface 24 when the soup is poured into the main body 20 and soup cup 26. With the main body 20 firmly wedged into soup cup 26, the user can freely tilt soup cup 26 in order to consume the soup without main body 20 being ejected from soup cup 26.

Figure 5:
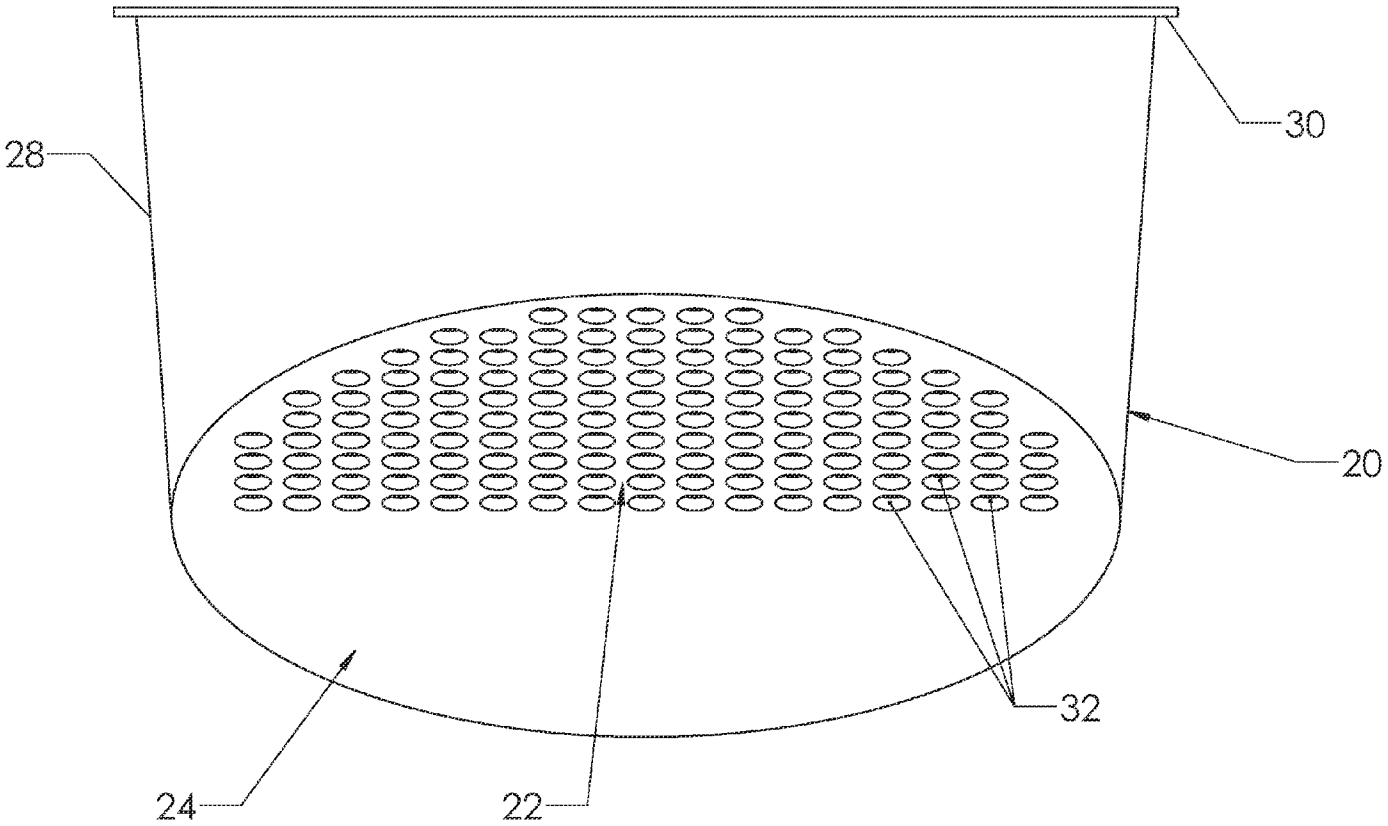
FIG. 5 is an elevation view, showing an alternate embodiment of the current invention.

FIG. 5 shows an alternate embodiment of main body 20. The embodiment shown in FIG. 5 preferably includes the primary features shown in the previous embodiments of the main body 20. However, the embodiment in FIG. 5 includes lip 30, which extends slightly from the outer radius of opening 21, as illustrated. In this embodiment, the downward-facing surface of lip 30 rests against the upper rim of the mouth of soup cup. This embodiment is useful in the event the container's inner diameter is larger than the main body's largest outer diameter if lip 30 were not present. Lip 30 allows main body 20 to rest at the opening of the soup cup by resting on the mouth of the soup cup.

In addition to the features listed, FIGS. 4-5 shown perforation holes 32 located on bottom surface 24. Perforation holes 32 preferably allow liquid soup to fall into the container while preventing solid pieces of soup from entering the soup container. Another important feature of bottom surface 24 is the size of perforation holes 32 contained in perforation region 22. Preferably, the size of perforation holes 32 are large enough to allow liquid to flow freely and easily, but small enough to retain the majority of solid morsels encountered in a typical soup or stew. An example of a solid that needs to be retained is peas. Peas are a common ingredient in soup, and peas are relatively small. This consideration should be taken into account in sizing the perforations for the preferred embodiments. It is possible to have different embodiments for different kinds of soup. The reader will note that, although perforation region 22 is shown to contain holes 32, alternate embodiments are possible. These are discussed further in the subsequent text.

Figure 6:
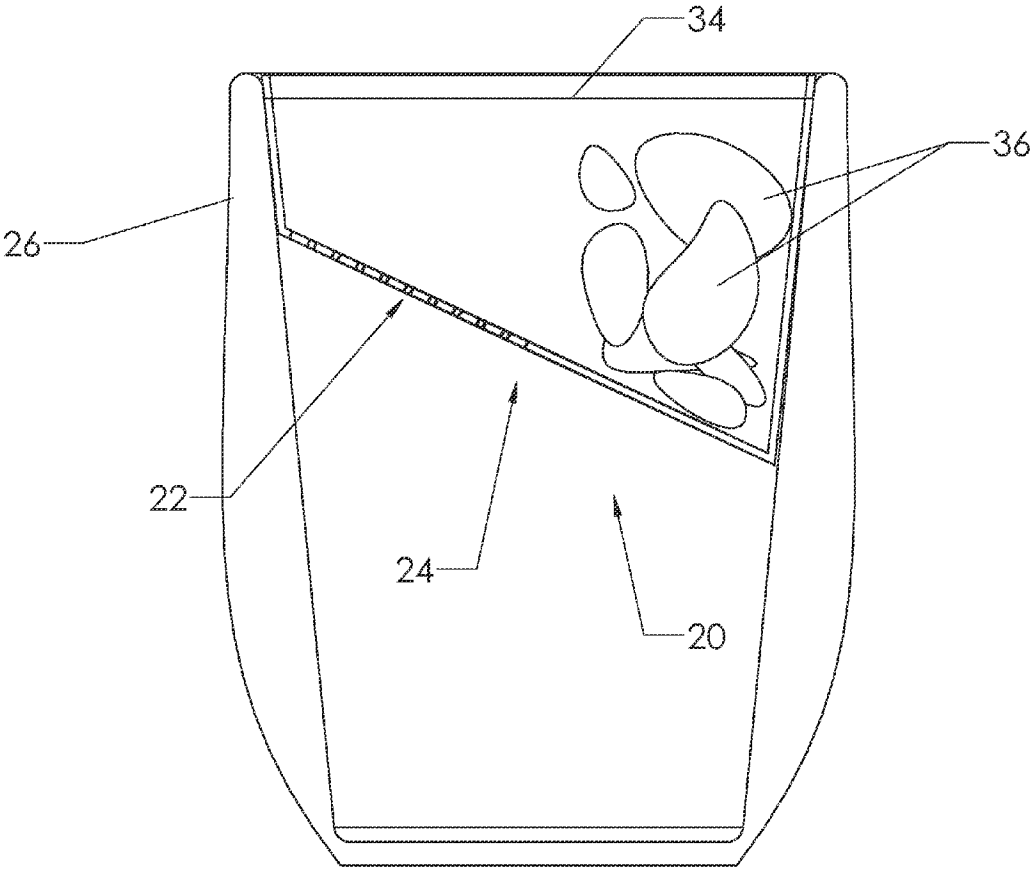
FIG. 6 is an elevation view, showing the current invention retaining the solid portions of soup near the mouth of the soup cup.

FIG. 6 shows soup cup 26 filled to liquid soup level 34 with main body 20 inside soup cup 26. FIG. 6 illustrates yet another component of bottom surface 24—the angle the bottom surface of main body 20 (bottom surface 24) forms with the mouth of liquid container 26. The reader will note that in this particular view, the plane formed with the mouth of soup cup 26 is also the horizontal plane. Preferably, this angle is between about 20° and about 40° with respect to a plane lying across the mouth of the container; however, the reader will note that this angle can span from 00 to just below 90°. This angle is important for a few reasons. First, the angle allows liquid soup to be retained in the region of the bottom surface 24 that does not contain perforated region 22. Second, the angled surface allows the solid portions of soup to be force closer to the mouth of the user as he or she tilts soup cup 26 towards the mouth. Finally, the repeated movement forced by an angled bottom surface 24 helps prevent large soup particles from getting stuck in the corners of main body 20.

Figure 7:
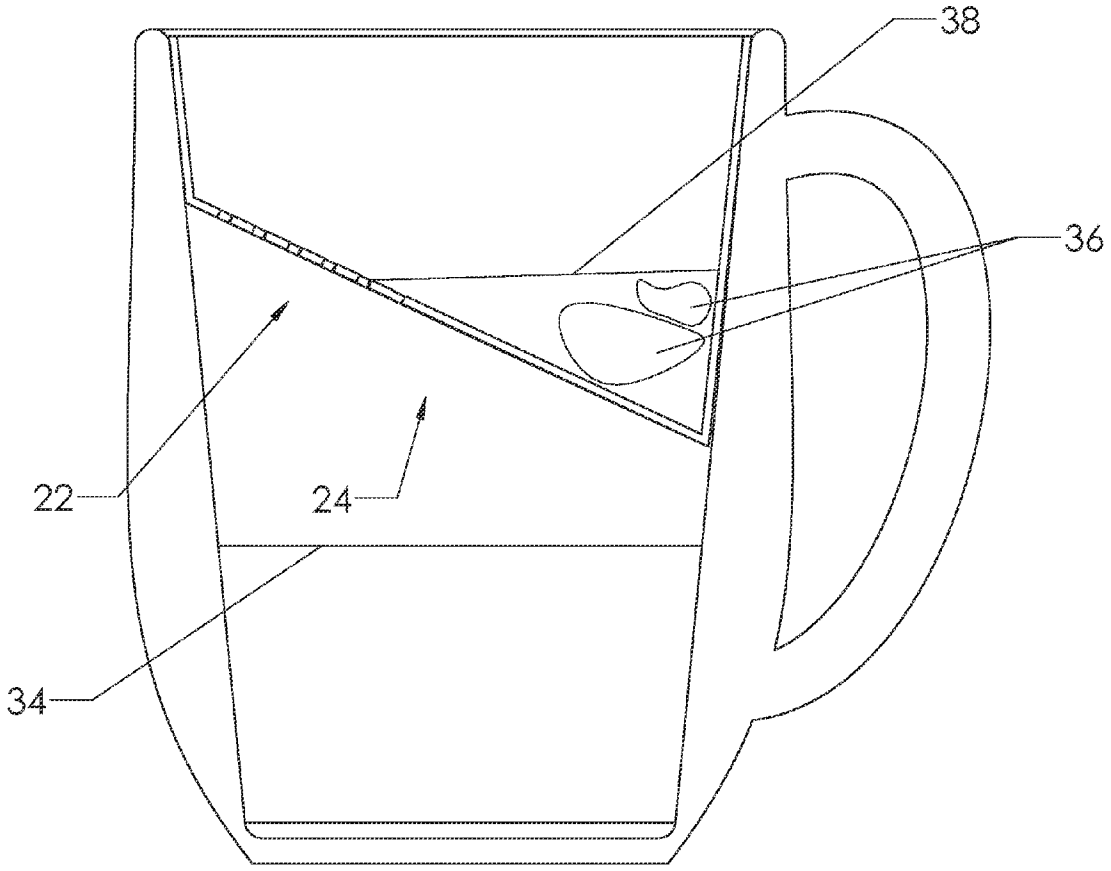
FIG. 7 is a sectional view, showing the soup retention capabilities of the current invention.

FIG. 7 illustrates the advantage, as discussed briefly in the preceding paragraph, of bottom surface 24 containing a region that is not perforated. In FIG. 6, liquid soup level 34 is at such a high level that soup level 34 is above main body 20, and the utility of soups separator 20 is unnecessary. However, when the liquid soup level 34 is below perforated region 22, the angle of bottom surface 24 allows for an easier displacement of the solid portions 36 towards the mouth of the user when the cup is tilted because a small amount of liquid will be retained in the non-perforated region of bottom surface 24. The level of liquid soup in bottom surface 24 is indicated by bottom surface liquid soup level 38. If the solid portions were resting on the surface of bottom surface 24 without liquid soup in that region, the solid contents would be more difficult to coerce towards the mouth of the cup. Additionally, the accumulated soup in the non-perforated region of bottom surface 24 keeps the solid soup portions 36 hydrated.

By positioning the liquid container in a manner such that the user is drinking from an orientation wherein the bottom surface is as close to the mouth of the container as possible, a sliding effect for the solids is generated when the cup is tipped toward the user's mouth. As described in the subsequent text in more detail, the soup cup 26 is tilted counter clockwise in the view in FIG. 6 so that the high point of bottom surface 24 is located proximate the consumer's mouth. The solid portions begin at the top of the "slide" where bottom surface 24 is solid. As soup cup 26 is tilted towards the mouth of the user, the solid soup portions 36 slide towards the mouth of the cup. This is explained further in the text below.

Figure 8:
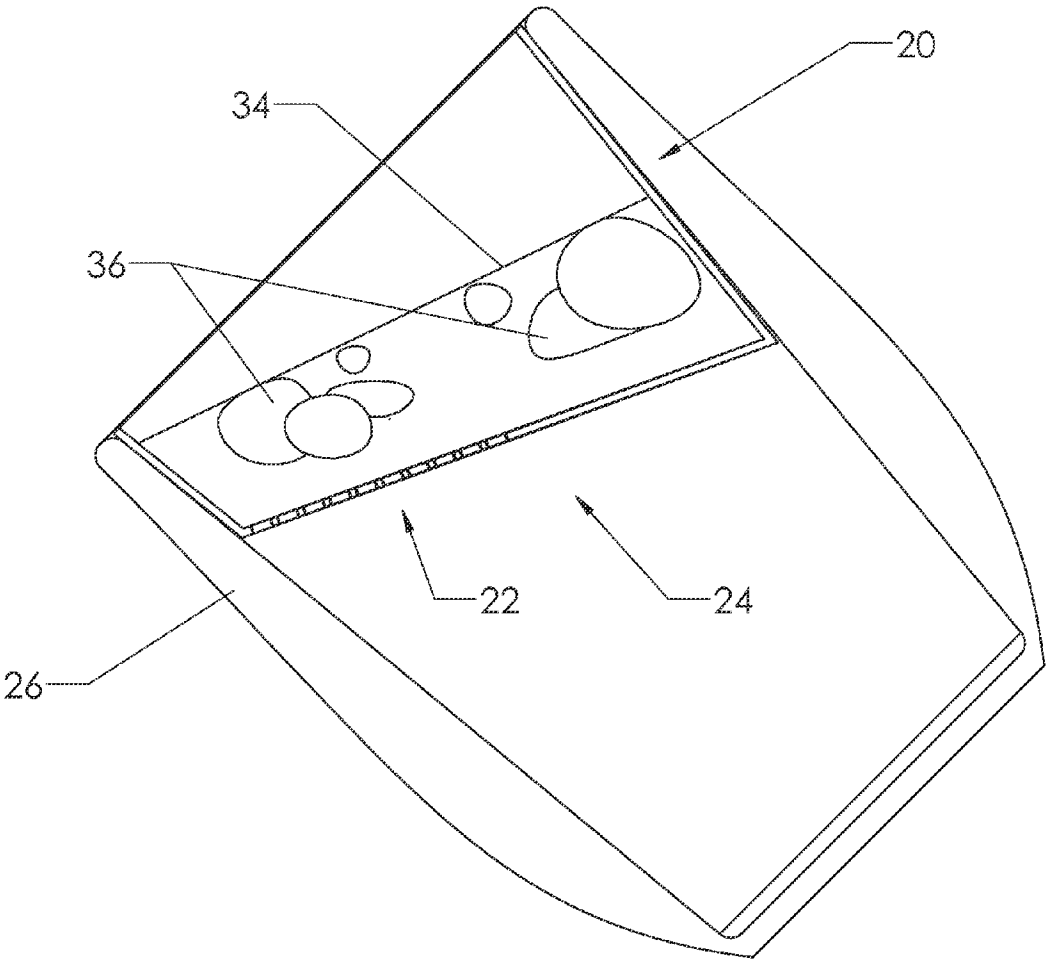
FIG. 8 is an elevation view, showing the effect of tilting the liquid container with the present invention installed.

FIG. 8 shows soup cup 26 and main body 20 as soup cup 26 is tilted toward the consumer's mouth. The soup cup 26 and main body 20 are filled with liquid and solid portions of soup, as illustrated. As in the previous figures, main body 20 retains solid portions 36 while allowing the liquid soup is both in soup cup 26 and separator 20. The reader can observe that as soup cup 26 is tilted towards the region where bottom surface 24 is closest to the mouth of soup cup 26 (this is a counter clockwise rotation from the position shown in FIG. 6) that both the solid and liquid components of the soup shift towards the user's mouth. This is most easily demonstrated by contrasting the location of solid portions 36 and liquid soup level 34 in FIGS. 6 and 8. In FIG. 6, solid portions 36 are contained mostly in the non-perforated region of bottom surface 24. In FIG. 8, solid portions 36 are spread throughout the region of bottom surface 24.

As solid portions 36 "slide" towards the side of soup cup 26 being tilted towards the user's mouth, the liquid component of the soup flowing through perforated region 22 drives solid portions 36 out of soup cup 26. This design allows the user to simply "drink" the soup without fishing around for solid chunks to eat. The current invention drives the solid portions of soup into the user's mouth without any extra effort required from the user apart from simply tilting the liquid container.

Figure 9:
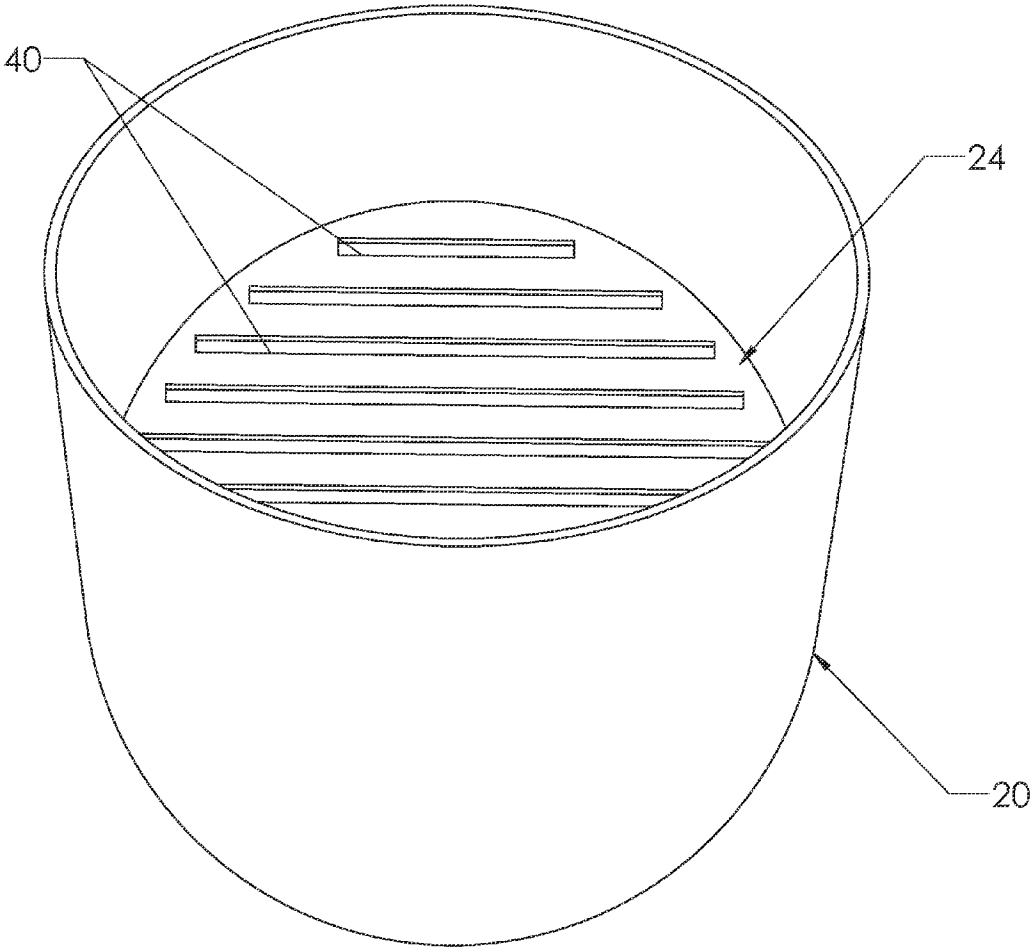
FIG. 9 is a perspective view, showing an alternate embodiment of the current invention.

As discussed in the preceding text, main body 20 may employ another method of retaining the solid portions of soup. FIG. 9 shows main body 20 with horizontal slots 40 used to retain solid portions of soup. Preferably, slots 40 act in a similar manner as the perforation holes discussed in the preceding embodiment by allowing liquid soup to fall through bottom surface 24, while solid portions 36 of soup are retained within main body 20. The reader will note that the present invention can take many forms and use many means in order to separate soup components and should not be limited to either of these sieving configurations. For example, a fine mesh (net-like material), a single hole or channel, or semicircular channels can be used in order to retain solid morsels of soup within main body 20.

Figure 10:
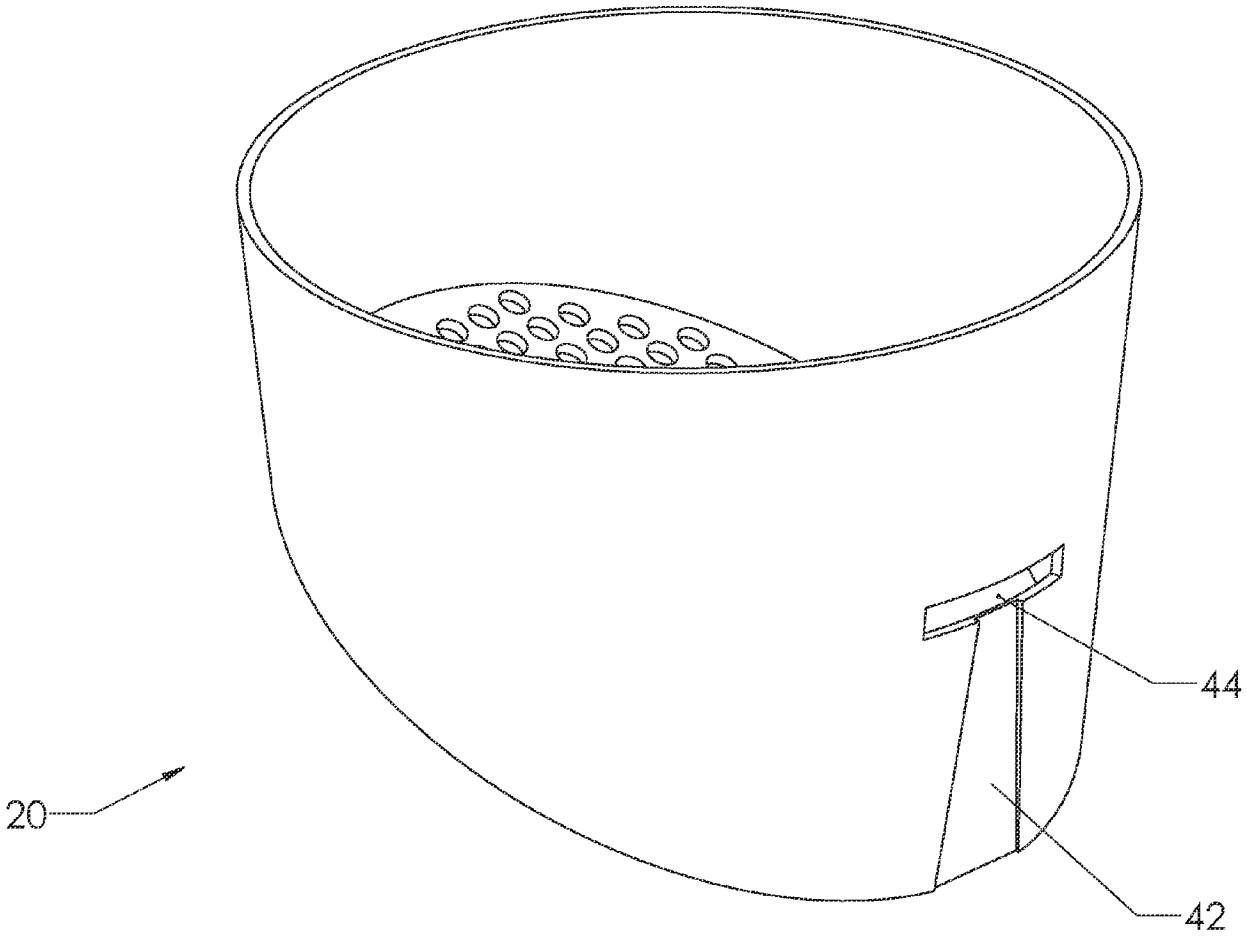
FIG. 10 is a perspective view, showing still another embodiment of the present invention.

FIG. 10 illustrates another embodiment of the current invention. This embodiment contains fluid slot 42 running along the side wall of main body 20. Preferably, fluid slot 42 is located on the sidewall opposite of perforation region 22, as illustrated. Fluid channel 44 preferably runs from the bottom of main body 20 to fluid slot 22. By tipping the soup container (containing main body 20) towards the direction of fluid channel 44, the user can fill the non-perforated region of bottom surface 24 with liquid soup. The soup flows through fluid channel 44, and then fills the non-perforated region of bottom surface 24 by flowing into fluid channel 42. The reader should note that FIG. 10 illustrates fluid channel 42 with an increasing cross-sectional area as the slot runs downward, but the invention is not limited to this configuration-a constant area channel is equally as effective.

The combination of the fluid slot and channel presents a key advantage. The user is able to fill the non-perforated region of the bottom surface with liquid soup by tilting the soup cup towards the fluid channel (away from the perforated region of bottom surface 24). When the user rotates the beverage container toward the fluid channel, liquid soup flows through the channel and into the fluid slot. Thus, the non-perforated region of the bottom surface is filled with liquid soup.

Figure 11:
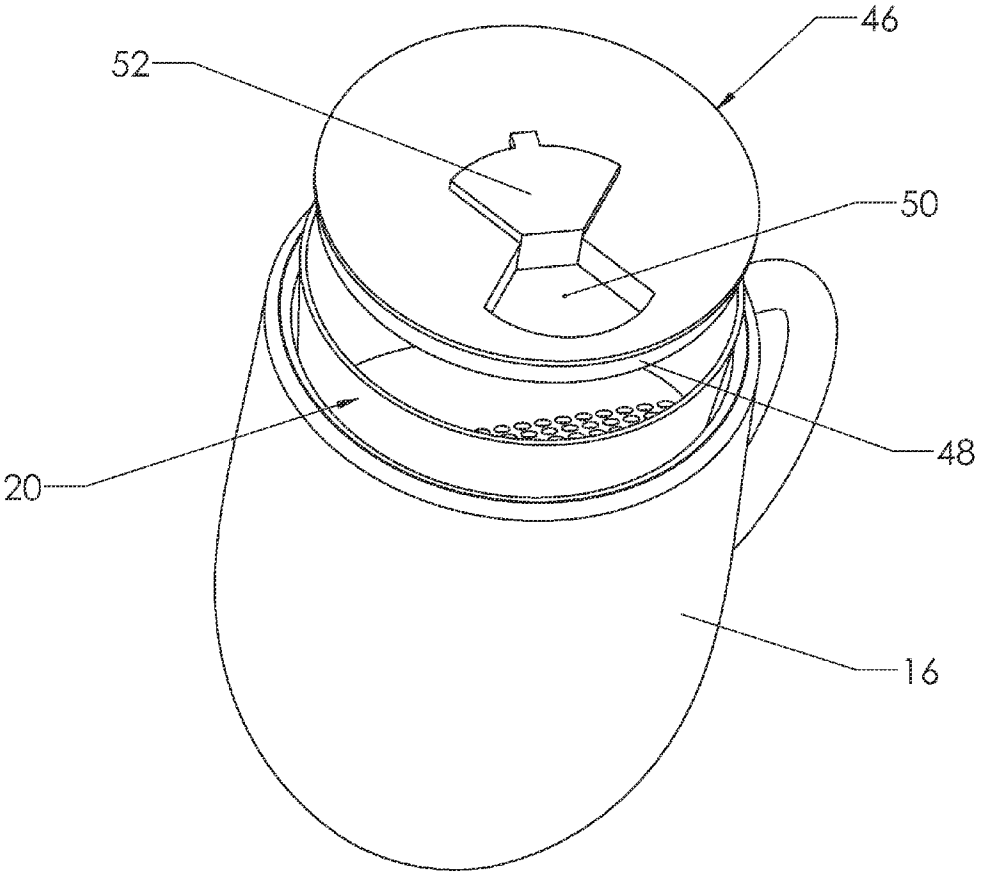
FIG. 11 is a perspective view, showing an embodiment of the current invention containing a cover.

In an alternate embodiment of the current invention, the main body includes a container cover. FIG. 11 shows container cover 46 fitting onto main body 20. Sealing diameter 48 creates a seal between container cover 46 and main body 20 by fitting into the inner diameter of main body 20. Preferably, container cover 46 contains a lip that engages the upper edge of beverage container 16. Container cover 46 allows the user the freedom to accomplish a few things. First, it allows the user more flexibility when traveling or transporting the beverage container while it is filled with soup. The user is less likely to spill soup if the container is covered, even if that cover is not sealed. Second, a container cover increases the capability of heat retention of the soup. Without a cover, the soup would lose heat more quickly than with the container covered and sealed. Finally, in the case where the solid soup portions remain in the non-perforated region of main body 20, the user can gently shake beverage container 16 to move the solid soup components to the perforated region of the bottom surface. Container cover 46 preferably prevents liquid and solid soup components from ejecting from beverage container 16 while user shakes the container.

In another embodiment of the current invention, container cover 46 contains cover opening 50. Cover opening 50 allows the user to consume soup using main body 20 without removing container cover 46. There are two main advantages to container cover 46 remaining on main body 20 and beverage container 16. First, the remnants of soup left on cover 46 are likely to drip/leak on the surrounding area if the cover is removed. Second, the heat transfer from the soup is slower if container cover 46 remains upon main body 20.

An alternate embodiment of the present invention comprises a disposable beverage container and sealable container cover. In this embodiment, the main body is either disposable or reusable. In the disposable version, the main body and liquid container can be a single part or separate parts. Additionally, there are multiple methods of fastening the cover to the container-such as snapping the cover onto the container, twisting the cover on using threads, or pressing the cover into the container to create a seal.

The preferred embodiment of the present invention is made of a material that is microwavable. As it is preferred that the current invention also be flexible, the ideal material is a flexible plastic or silicon. This type of material has become popular recently, so having the invention manufactured from a material such as this is convenient and cost-effective. The device could also be fabricated using a firmer plastic material, but this would inhibit the wedging effect employed.

A description of a few embodiments of the present invention has been discussed in detail. However, a few points in regards to the flexibility allowed using the present invention should be established. First, (as stated in the preceding text) the main body 20 allows a user to travel while the soup is consumed. Of course, it is not possible to eat soup with a spoon and bowl while driving or riding in a car, but the main body allows a user to easily consume soup and travel. Second, it is very common for individuals in the work place to eat while working. Using the main body 20 to consume soup affords the user a free hand while working on (using) a computing device, cellular phone, tablet, or while reading a book. Finally, the "one-size-fits-all" configuration allows the main body to fit in many beverage containers, thereby awarding great flexibility to the user when using the main body.

Although the preceding description is contains seemingly comprehensive detail, it should be viewed as providing explanations of only some of the many possible embodiments of the present invention. Thus, the scope of the invention should be fixed by the claims drafted rather than any specific example given.

Having described my invention, I claim:

1. A food product separating device to be inserted into a container having an upper portion, an upper opening, a base, and an enclosed interior, comprising:

a. a main body, including, i. a circular side wall having an upper edge configured to fit inside of said container and extend completely around said upper portion of said container, and a lower edge, ii. said circular side wall being angled inward when traveling in a direction from said upper edge to said lower edge, said circular side wall being configured to be wedged into said container and thereby create a liquid seal between said circular side wall and said container, iii. a bottom surface attached to said lower edge of said side wall and creating a liquid seal between said bottom surface and said side wall, having a first region and a second region, wherein said first region of said bottom surface is perforated and said second region is solid, iv. an opening defined by said upper edge of said side wall;

b. wherein said upper edge is proximate said upper opening of said container;

c. wherein said bottom surface of said main body is inclined such that said second region is lower than said first region;

d. said first region being offset downward from said upper edge of said side wall; and e. said circular side wall and said bottom surface combining to create an enclosed volume within said main body that is segregated from said enclosed interior of said container so that any liquid communication between said enclosed volume within said main body and said enclosed interior of said container must pass through said perforated first region.

2. The food product separating device as recited in claim 1, wherein said first region of said bottom surface contains a plurality of small diameter holes.

3. The food product separating device as recited in claim 2, wherein said plurality of holes encompass less than 80 percent of said bottom surface.

4. The food product separating device as recited in claim 3, wherein said plurality of holes encompass more than 20 percent of said bottom surface.

5. The food product separating device as recited in claim 1, wherein said bottom surface lies on a diagonal plane.

6. The food product separating device as recited in claim 1, further comprising a cover configured to removably attach to said upper edge.

7. The food product separating device as recited in claim 6, wherein said cover includes a closable opening.

8. The food product separating device as recited in claim 1, wherein said first region of said bottom surface contains a series of lateral slots within said first region.

9. A food product separating device as recited in claim 1, wherein said upper edge of said main body includes a lip configured to bear against said upper portion of said container.

10. A food product separating device to be inserted into a container having an upper opening, an upper portion a base, and an enclosed interior, wherein said food product separating device comprises:

a. a main body, including, i. a circular side wall having an upper edge configured to fit inside of said container and extend completely around said upper portion of said container, and a lower edge, ii. said circular side wall being angled inward when traveling in a direction from said upper edge to said lower edge, said circular side wall being configured to be wedged into said container and thereby create a liquid seal between said circular side wall and said container, iii. a bottom surface attached to said lower edge of said side wall and creating a liquid seal between said bottom surface and said side wall, said bottom surface having a perforated region and a solid region, iv. an opening defined by said upper edge of said side wall:

b. wherein said upper edge of said side wall is configured to engage with said upper portion of said container such that said bottom surface is free of said base of said container;

c. wherein said bottom surface is inclined such that said solid region is lower than said perforated region;

d. said perforated region being offset downward from said upper edge of said side wall; and e. said circular side wall and said bottom surface combining to create an enclosed volume within said main body that is segregated from said enclosed interior of said container so that any liquid communication between said enclosed volume within said main body and said enclosed interior of said container must pass through said perforated region.

11. The food product separating device as recited in claim 10, wherein said perforated region of said bottom surface includes a plurality of holes.

12. The food product separating device as recited in claim 11, wherein said plurality of holes encompass less than 80 percent of said bottom surface.

13. The food product separating device as recited in claim 12, wherein said plurality of holes encompass more than 20 percent of said bottom surface.

14. The food product separating device as recited in claim 10, wherein said bottom surface lies on a diagonal plane.

15. The food product separating device as recited in claim 10, further comprising a cover configured to removably attach to said upper edge of said main body.

16. The food product separating device as recited in claim 15, wherein said cover includes a closable opening.

17. The food product separating device as recited in claim 10, wherein said first region of said bottom surface includes a series of lateral slots within said first region.

18. The food product separating device as recited in claim 10, wherein said upper edge of said main body includes a lip configured to bear against said upper portion of said container.

* * * * *